US008830279B2

(12) United States Patent
Cheng et al.

(10) Patent No.: US 8,830,279 B2
(45) Date of Patent: Sep. 9, 2014

(54) LIQUID CRYSTAL DISPLAY AND DRIVING METHOD THEREOF

(75) Inventors: Hsiao-Chung Cheng, Hsin-Chu (TW); Chao-Ching Hsu, Hsin-Chu (TW); Jen-Chieh Chen, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 230 days.

(21) Appl. No.: 13/346,693

(22) Filed: Jan. 9, 2012

(65) Prior Publication Data

US 2012/0287170 A1 Nov. 15, 2012

(30) Foreign Application Priority Data

May 11, 2011 (TW) ..... 100116476 A

(51) Int. Cl.
*G09G 3/36* (2006.01)

(52) U.S. Cl.
CPC ..... *G09G 3/3614* (2013.01); *G09G 2320/0247* (2013.01); *G09G 2360/16* (2013.01)
USPC ..... 345/690

(58) Field of Classification Search
CPC combination set(s) only.
See application file for complete search history.

(56) References Cited

U.S. PATENT DOCUMENTS

| | | | | |
|---|---|---|---|---|
| 7,079,097 | B2 | 7/2006 | Lee | |
| 7,643,002 | B2 * | 1/2010 | Kang et al. | 345/100 |
| 7,719,503 | B2 * | 5/2010 | Hosihara et al. | 345/87 |
| 2006/0092120 | A1 | 5/2006 | Nose | |
| 2006/0114220 | A1 | 6/2006 | Wang | |
| 2007/0146281 | A1 * | 6/2007 | Hosihara et al. | 345/96 |
| 2008/0174524 | A1 * | 7/2008 | Kim et al. | 345/63 |
| 2008/0246779 | A1 * | 10/2008 | Lee et al. | 345/690 |

* cited by examiner

*Primary Examiner* — Van Chow
(74) *Attorney, Agent, or Firm* — Winston Hsu; Scott Margo

(57) ABSTRACT

A liquid crystal display having adaptive driving mechanism includes plural pixel array areas and a driving module. Each pixel array area has a plurality of pixels. The driving module includes a signal generation unit for generating grey-level signals corresponding to the pixels based on input image data, a weighting conversion unit for converting the grey-level signals corresponding to the pixels into a plurality of weightings, a weighting processing unit for generating a weighting sum by summing up the weightings corresponding to the pixel array area, an inversion-mode setting unit for setting a polarity inversion mode according to the weighting sum, and a data signal output unit. The data signal output unit is utilized for providing a plurality of data signals to be written into the pixel array area based on the polarity inversion mode.

9 Claims, 4 Drawing Sheets

LIQUID CRYSTAL DISPLAY AND DRIVING METHOD THEREOF

BACKGROUND

1. Technical Field

The disclosure relates to a liquid crystal display and driving method thereof, and more particularly, to a liquid crystal display having adaptive driving mechanism and driving method thereof.

2. Description of the Related Art

Liquid crystal displays (LCDs) have advantages of a thin profile, low power consumption, and low radiation, and are broadly adopted for application in media players, mobile phones, personal digital assistants (PDAs), computer displays, and flat screen televisions. The operation of a liquid crystal display is featured by modulating the voltage drop across opposite sides of a liquid crystal layer for twisting the angles of liquid crystal molecules in the liquid crystal layer so that the transmittance of the liquid crystal layer can be controlled for illustrating images with the aid of light source provided by a backlight module. It is well known that the polarity of voltage drop across opposite sides of the liquid crystal layer should be inverted periodically for protecting the liquid crystal layer from causing permanent deterioration due to polarization, and also for reducing image sticking effect on the LCD device. In general, the method of driving LCDs is primarily classified into the frame inversion driving method, the column inversion driving method, the dot inversion driving method, and the plural-dot inversion driving method. Among which, the plural-dot inversion driving method may be further classified into the two-dot inversion driving method, the four-dot inversion driving method, and the eight-dot inversion driving method, etc.

FIG. 1 is a schematic diagram showing the pixel polarities of frames displayed by LCDs based on various inversion driving methods, wherein "+" represents positive polarity and "−" represents negative polarity. While driving an LCD based on a column inversion mode, as illustrated by the first frame shown in FIG. 1, the polarities of data signals applied to each pixel are inverted with respect to alternating columns. While driving an LCD based on a dot inversion mode, as illustrated by the second frame shown in FIG. 1, the data signals having opposite polarities are applied to adjacent pixels. While driving an LCD based on a two-dot inversion mode, as illustrated by the third frame shown in FIG. 1, the data signals having one and the same polarity are applied to two adjacent pixels in the same column, and other pixels adjacent to the two pixels are furnished with data signals having a polarity opposite to the data signals of the two pixels. While driving an LCD based on a four-dot inversion mode, as illustrated by the fourth frame shown in FIG. 1, the data signals having one and the same polarity are applied to four adjacent pixels in the same column, and other pixels adjacent to the four pixels are furnished with data signals having a polarity opposite to the data signals of the four pixels. While driving an LCD based on an eight-dot inversion mode, as illustrated by the fifth frame shown in FIG. 1, the data signals having one and the same polarity are applied to eight adjacent pixels in the same column, and other pixels adjacent to the eight pixels are furnished with data signals having a polarity opposite to the data signals of the eight pixels.

Regarding display performance corresponding to the five inversion modes described above, the image displayed based on the dot inversion mode exhibits less flicker than the plural-dot inversion mode. The images displayed based on the two-dot, four-dot and eight-dot inversion modes are more and more susceptible to flicker. And, the image displayed based on the column inversion mode has the most serious flicker. However, in comparison with the column inversion mode and the plural-dot inversion mode, the display driving operation based on the dot inversion mode incurs greater power consumption. That is, how to obtain better performance in both image quality and power consumption has become one of the most important topics nowadays.

SUMMARY

In accordance with an embodiment, a driving method for driving a liquid crystal display having a plurality of pixel array areas is provided. The driving method comprises: generating a plurality of grey-level signals corresponding to the pixels of one pixel array area based on input image data; converting the grey-level signals corresponding to the pixels into a plurality of weightings; generating a weighting sum by summing up the weightings corresponding to the pixel array area; and performing a pixel data writing operation of the pixel array area based on a polarity inversion mode corresponding to a weighting range into which the weighting sum falls.

The invention further provides a liquid crystal display having adaptive driving mechanism. The liquid crystal display comprises a plurality of pixel array areas, a signal generation unit, a weighting conversion unit, a weighting processing unit, an inversion-mode setting unit, and a data signal output unit. Each of the pixel array areas includes plural pixels. The signal generation unit is employed to generate grey-level signals corresponding to the pixels based on input image data. The weighting conversion unit is utilized for converting the grey-level signals corresponding to the pixels into a plurality of weightings. The weighting processing unit is put in use for generating a weighting sum by summing up the weightings corresponding to the pixel array area. The inversion-mode setting unit is employed to set a polarity inversion mode according to the weighting sum. The data signal output unit is utilized for providing a plurality of data signals to be written into the pixel array area based on the polarity inversion mode.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto. Furthermore, the step serial numbers regarding the driving method are not meant thereto limit the operating sequence, and any rearrangement of the operating sequence for achieving same functionality is still within the spirit and scope of the invention.

Figure 1:
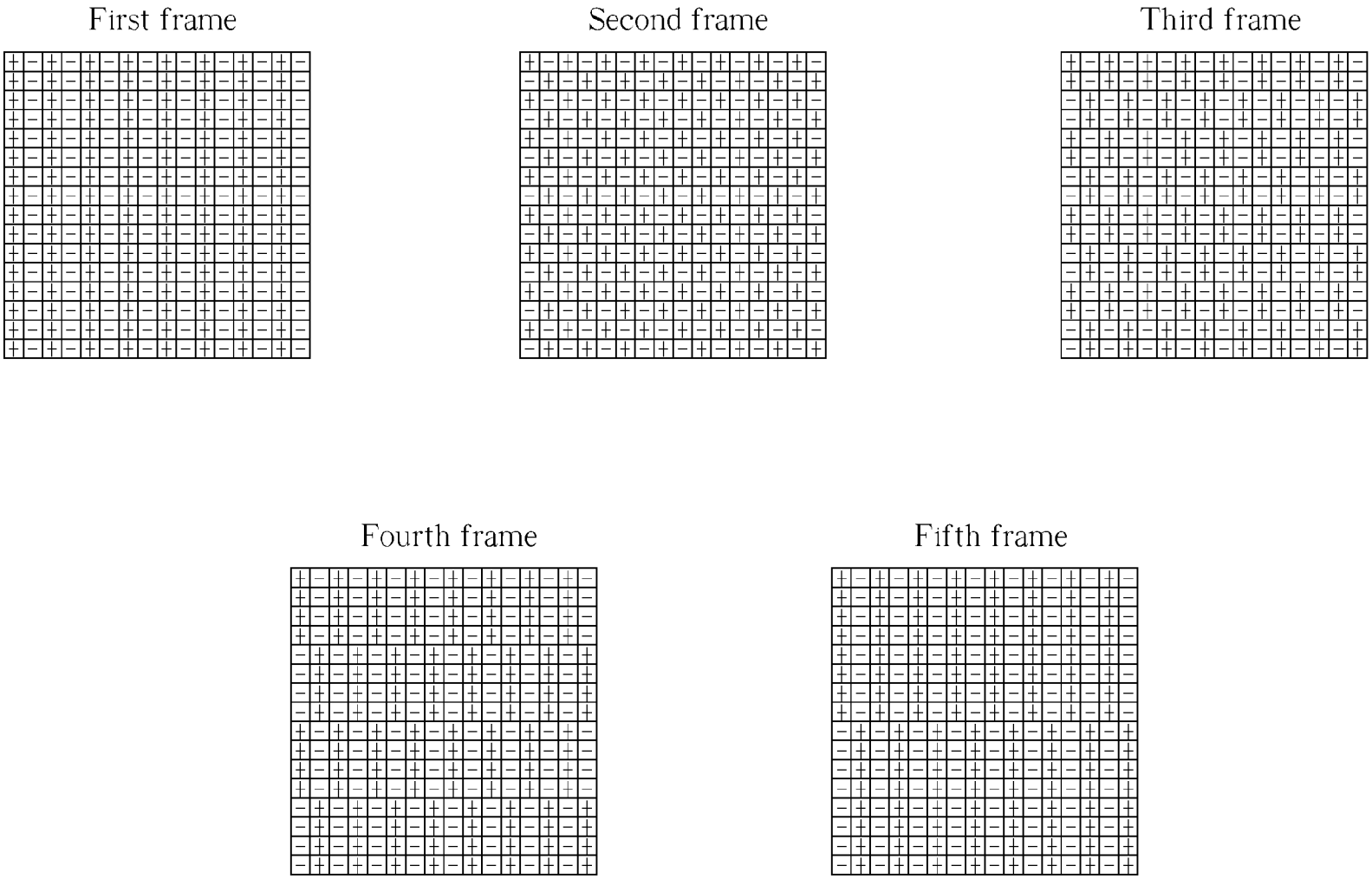
FIG. 1 RELATED ART
FIG. 1 is a schematic diagram showing the pixel polarities of frames displayed by LCDs based on various inversion driving methods.
Figure 2:
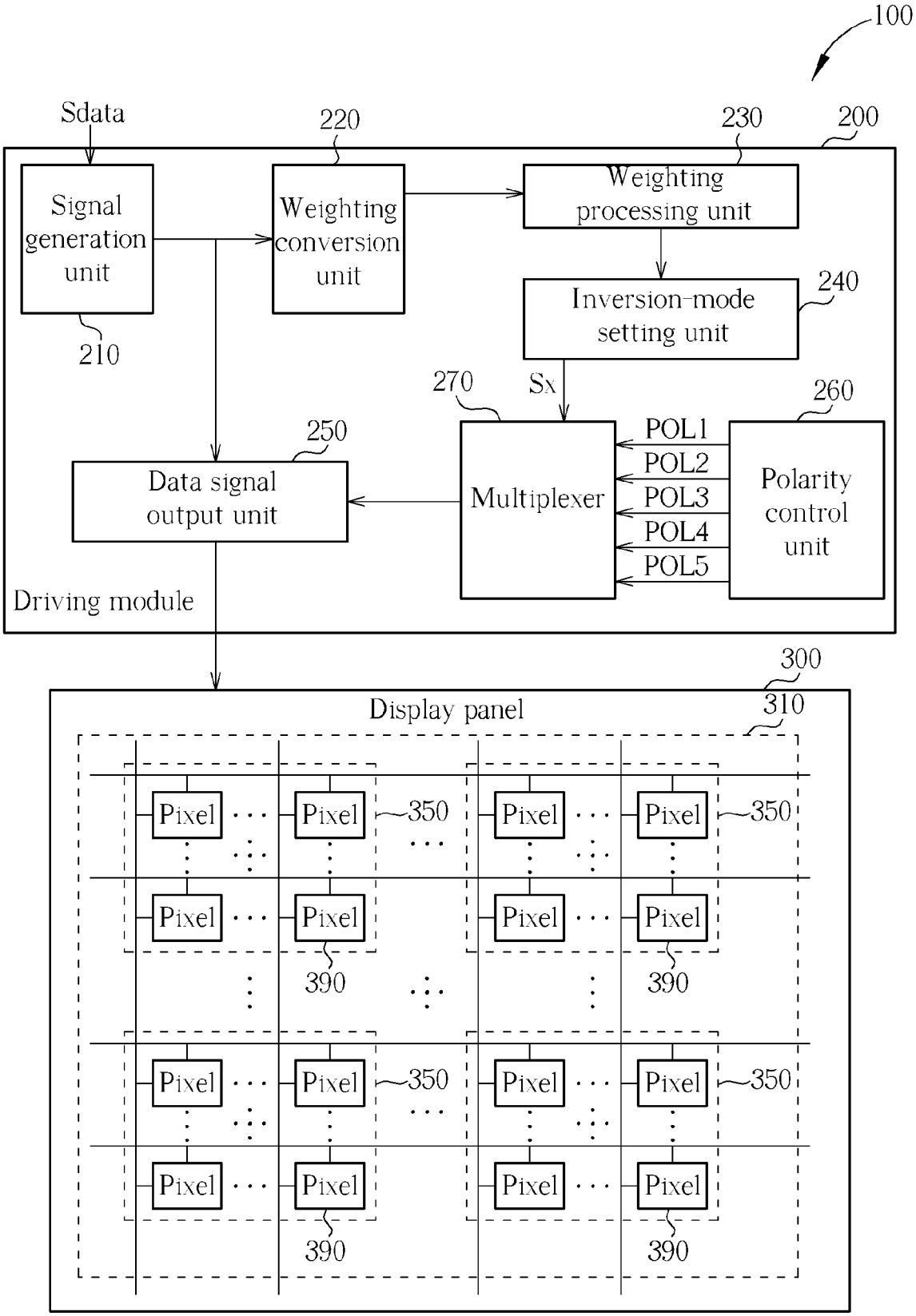
FIG. 2 is a schematic diagram showing the structure of a liquid crystal display in accordance with a preferred embodiment.

FIG. 2 is a schematic diagram showing the structure of a liquid crystal display in accordance with a preferred embodiment. As shown in FIG. 2, the liquid crystal display 100 comprises a driving module 200 and a display panel 300. The display panel 300 includes a plurality of pixel array areas 350. Each pixel array area 350 has plural pixels 390 arranged in a matrix form. That is, the image display area 310 of the display panel 300 is sectioned into the plurality of pixel array areas 350. The driving module 200 includes a signal generation unit 210, a weighting conversion unit 220, a weighting processing unit 230, an inversion-mode setting unit 240, a data signal output unit 250, a polarity control unit 260, and a multiplexer 270. In one embodiment, the driving module 200 is constructed based on a half source driver (HSD) architecture for providing plural data signals furnished to the display panel 300.

The signal generation unit 210 is utilized for generating grey-level signals corresponding to the pixels 390 based on input image data Sdata. The weighting conversion unit 220, electrically connected to the signal generation unit 210, is put in use for converting the grey-level signals corresponding to the pixels 390 into a plurality of weightings. In one embodiment, the weighting conversion unit 220 is further employed to normalize the weightings, e.g. normalizing the weightings into a weighting range from 0 to 10. The weighting processing unit 230, electrically connected to the weighting conversion unit 220, is used for summing up the weightings corresponding to each pixel array area so as to generate one weighting sum. The inversion-mode setting unit 240, electrically connected to the weighting processing unit 230, is utilized for setting one polarity inversion mode corresponding to each pixel array area based on the weighting sum thereof so as to output a selection signal Sx having at least one bit.

The polarity control unit 260 is utilized for providing a plurality of polarity control signals, and each of the polarity control signals is employed to control one corresponding inversion driving operation. In the embodiment shown in FIG. 2, the polarity control unit 260 provides five polarity control signals POL1-POL5. Among which, the polarity control signal POL1 is employed to control a column inversion driving operation, the polarity control signal POL2 is employed to control an eight-dot inversion driving operation, the polarity control signal POL3 is employed to control a four-dot inversion driving operation, the polarity control signal POL4 is employed to control a two-dot inversion driving operation, and the polarity control signal POL5 is employed to control a dot inversion driving operation. In another embodiment, the polarity control unit 260 may be employed to provide more or fewer polarity control signals, and the inversion driving operations available for selection are not limited to the five inversion driving operations corresponding to the polarity control signals POL1-POL5. It is noted that the bit number of the selection signal Sx is determined according to the amount of the polarity control signals available for selection.

The multiplexer 270, electrically connected to the inversion-mode setting unit 240 and the polarity control unit 260, is utilized for selecting one corresponding polarity control signal furnished to the data signal output unit 250 according to the selection signal Sx. The data signal output unit 250, electrically connected to the signal generation unit 210 and the multiplexer 270, is utilized for providing the data signals to be written into each pixel array area 350 based on one corresponding polarity inversion mode under control of one selected polarity control signal. Basically, the weighting conversion unit 220 converts the grey-level signals corresponding to the pixels 390 into the weightings according to a predetermined grey-level/weighting mapping relationship. And, the grey-level/weighting mapping relationship may be created based on inversion flickering seriousness corresponding to each grey level. Since the inversion operation corresponding to the middle grey level is more susceptible to flicker than the inversion operation corresponding to the upper or lower grey level. Particularly, the inversion operation corresponding to the uppermost or lowermost grey level exhibits almost no flicker. For that reason, in one embodiment, the grey-level/weighting mapping relationship is utilized for mapping the lowermost grey level to a first low weighting, mapping the uppermost grey level to a second low weighting, and mapping a first middle grey level to a highest weighting. Besides, the grey-level/weighting mapping relationship is further utilized for mapping a second middle grey level between the lowermost grey level and the first middle grey level to a weighting between the first low weighting and the highest weighting, and mapping a third middle grey level between the uppermost grey level and the first middle grey level to a weighting between the second low weighting and the highest weighting. It is noted that the second low weighting may be identical to or different from the first low weighting.

To sum up, in the operation of the liquid crystal display 100, the driving module 200 is employed to provide an adaptive driving mechanism for determining the preferred inversion mode of data signals to be written into each pixel array area 350 based on one corresponding area grey level statistical feature (weighting sum). For example, the driving module 200 may provide data signals based on column inversion mode for the pixel array area 350 featured by low weighting sum. Alternatively, the driving module 200 may provide data signals based on dot/plural-dot inversion mode for the pixel array area 350 featured by high weighting sum. As a result, the liquid crystal display 100 is able to achieve better performance in both image quality and power consumption.

Figure 3:
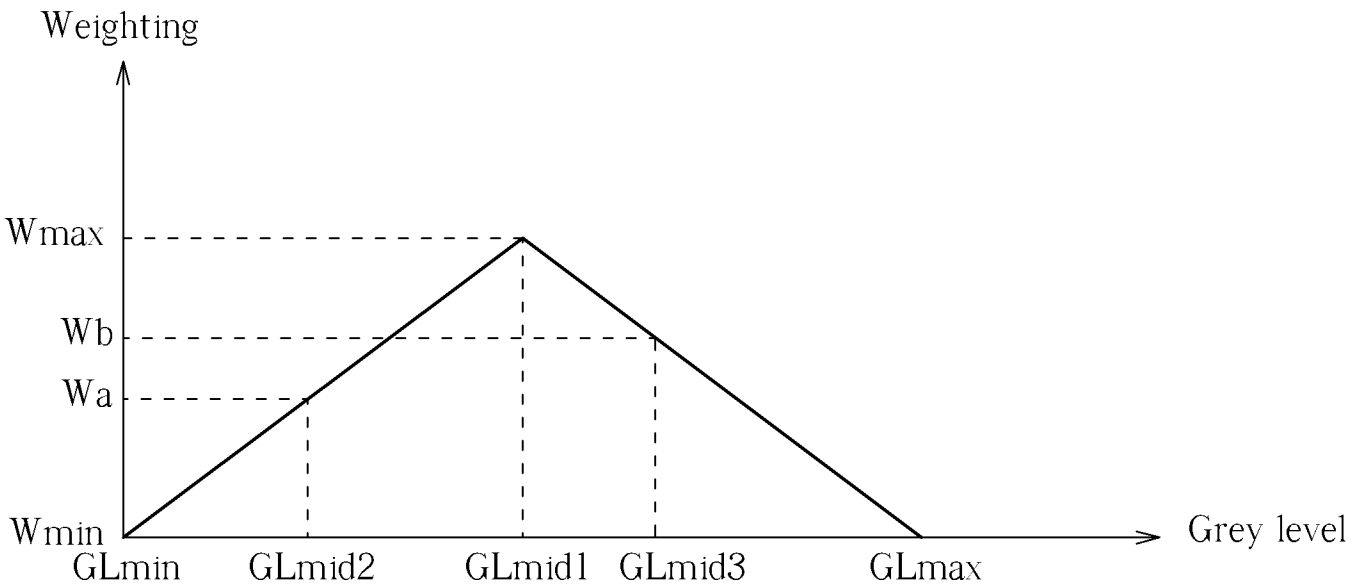
FIG. 3 is a diagram schematically showing the dependence of weighting upon grey level in accordance with a preferred embodiment.

FIG. 3 is a diagram schematically showing the dependence of weighting upon grey level in accordance with a preferred embodiment. As shown in FIG. 3, the lowermost grey level GLmin and the uppermost grey level GLmax are both mapped to the lowest weighting Wmin, and the first middle grey level GLmid1 is mapped to the highest weighting Wmax. That is, the inversion flickering corresponding to the first middle grey level GLmid1 is most serious. Besides, the second middle grey level GLmid2 between the lowermost grey level GLmin and the first middle grey level GLmid1 is mapped to a weighting Wa between the lowest weighting Wmin and the highest weighting Wmax, and the third middle grey level GLmid3 between the uppermost grey level GLmax and the first middle grey level GLmid1 is mapped to a weighting Wb between the lowest weighting Wmin and the highest weighting Wmax. It is noted that the weighting increases following an increase of the grey level during the range from the lowermost grey level GLmin to the first middle grey level GLmid1, and the weighting decreases following an increase of the grey level during the range from the first middle grey level GLmid1 to the uppermost grey level GLmax.

Figure 4:
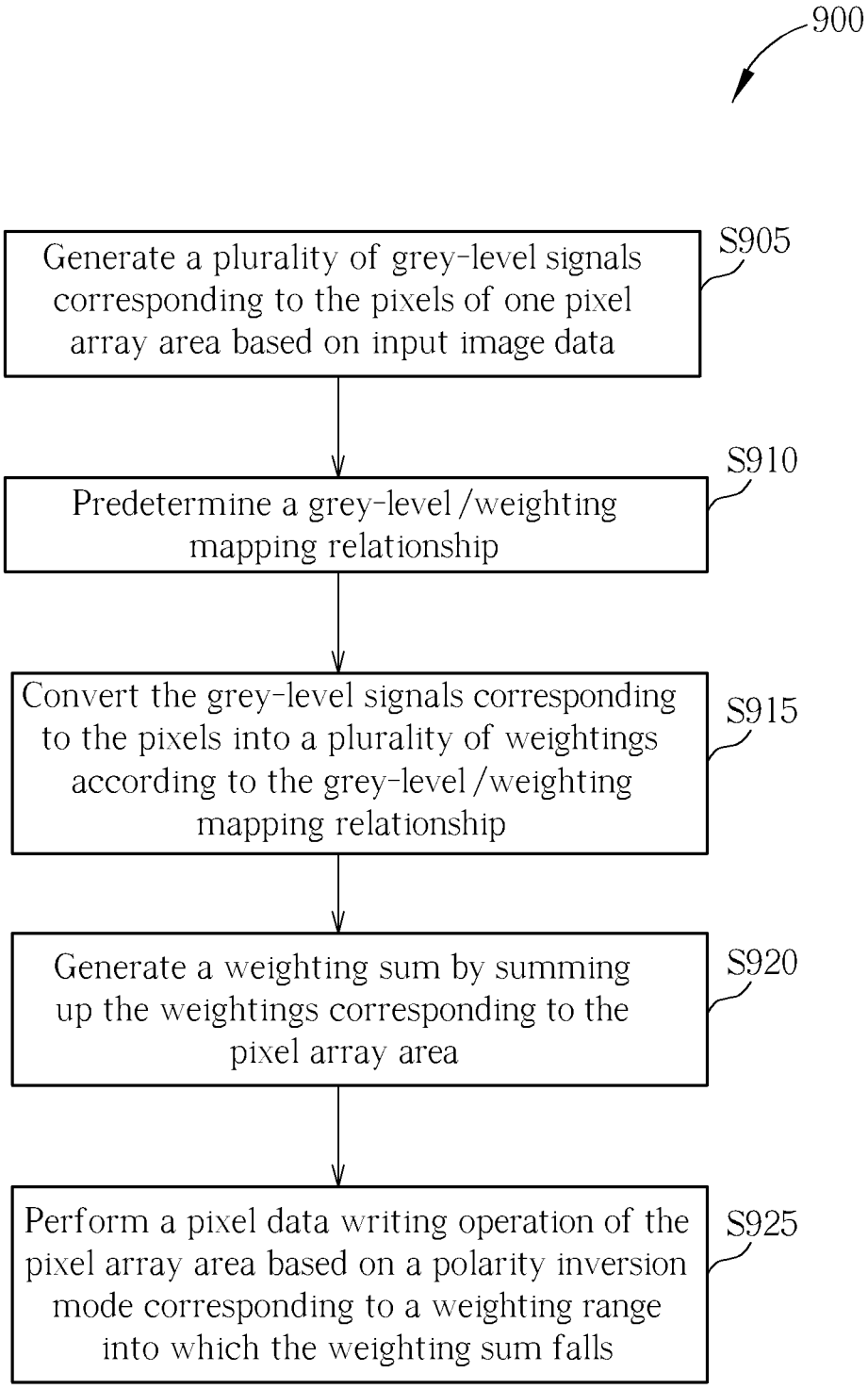
FIG. 4 is a flowchart depicting a driving method for use in a liquid crystal display having plural pixel array areas.

FIG. 4 is a flowchart depicting a driving method for use in a liquid crystal display having plural pixel array areas. The flow 900 shown in FIG. 4 provides the driving method adaptive for driving the liquid crystal display 100 illustrated in FIG. 2. The flow 900 of the driving method comprises the following steps:

Step S905: generating a plurality of grey-level signals corresponding to the pixels of one pixel array area based on input image data;

Step S910: predetermining a grey-level/weighting mapping relationship;

Step S915: converting the grey-level signals corresponding to the pixels into a plurality of weightings according to the grey-level/weighting mapping relationship;

Step S920: generating a weighting sum by summing up the weightings corresponding to the pixel array area; and Step S925: performing a pixel data writing operation of the pixel array area based on a polarity inversion mode corresponding to a weighting range into which the weighting sum falls.

In one embodiment, the grey-level/weighting mapping relationship is created based on the inversion flickering seriousness corresponding to each grey level. In another embodiment, the grey-level/weighting mapping relationship is employed to map a lowermost grey level to a first low weighting, map an uppermost grey level to a second low weighting, and map a first middle grey level to a highest weighting, wherein the second low weighting may be identical to or different from the first low weighting. Also, the grey-level/weighting mapping relationship is further employed to map a second middle grey level between the lowermost grey level and the first middle grey level to a weighting between the first low weighting and the highest weighting, and map a third middle grey level between the uppermost grey level and the first middle grey level to a weighting between the second low weighting and the highest weighting.

Besides, the operation process of the step S925 may comprise: performing the pixel data writing operation of the pixel array area based on the column inversion mode if the weighting sum falls into a first weighting range; performing the pixel data writing operation of the pixel array area based on the eight-dot inversion mode if the weighting sum falls into a second weighting range; performing the pixel data writing operation of the pixel array area based on the four-dot inversion mode if the weighting sum falls into a third weighting range; performing the pixel data writing operation of the pixel array area based on the two-dot inversion mode if the weighting sum falls into a fourth weighting range; and performing the pixel data writing operation of the pixel array area based on the dot inversion mode if the weighting sum falls into a fifth weighting range. The aforementioned first through fifth weighting ranges are non-overlapped with each other and increase in sequence.

In conclusion, the present invention provides a liquid crystal display having adaptive driving mechanism and driving method thereof for determining the preferred inversion mode of data signals to be written into each pixel array area based on one corresponding area grey level statistical feature (weighting sum), thereby achieving better performance in both image quality and power consumption.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A liquid crystal display, comprising:

a plurality of pixel array areas, each pixel array area including plural pixels;

a signal generation unit for generating grey-level signals corresponding to the pixels based on input image data;

a weighting conversion unit for converting the grey-level signals corresponding to the pixels into a plurality of weightings;

a weighting processing unit for generating a weighting sum by summing up the weightings corresponding to the pixel array area;

an inversion-mode setting unit for outputting a selection signal according to the weighting sum;

a polarity control unit for providing a plurality of polarity control signals;

a multiplexer for selecting one polarity control signal corresponding to a weighting range into which the weighting sum falls according to the selection signal; and a data signal output unit for providing a plurality of data signals to be written into the pixel array area based on a polarity inversion mode under control of the selected polarity control signal.

2. The liquid crystal display of claim 1, wherein the polarity inversion mode is a column inversion mode.

3. The liquid crystal display of claim 1, wherein the polarity inversion mode is a dot inversion mode or a plural-dot inversion mode.

4. The liquid crystal display of claim 3, wherein the plural-dot inversion mode is a two-dot inversion mode, a four-dot inversion mode, or an eight-dot inversion mode.

5. The liquid crystal display of claim 1, wherein the weighting conversion unit is utilized for converting the grey-level signals corresponding to the pixels into the weightings according to a predetermined grey-level/weighting mapping relationship.

6. The liquid crystal display of claim 5, wherein the grey-level/weighting mapping relationship is created based on inversion flickering seriousness corresponding to each grey level.

7. The liquid crystal display of claim 5, wherein the weighting conversion unit is utilized for mapping a lowermost grey level to a first low weighting, mapping an uppermost grey level to a second low weighting, and mapping a first middle grey level to a highest weighting based on the grey-level/weighting mapping relationship.

8. The liquid crystal display of claim 7, wherein the second low weighting is identical to or different from the first low weighting.

9. The liquid crystal display of claim 7, wherein the weighting conversion unit is further utilized for mapping a second middle grey level between the lowermost grey level and the first middle grey level to a weighting between the first low weighting and the highest weighting, and mapping a third middle grey level between the uppermost grey level and the first middle grey level to a weighting between the second low weighting and the highest weighting based on the grey-level/weighting mapping relationship.

* * * * *